US007922221B2

(12) United States Patent
Fan

(10) Patent No.: US 7,922,221 B2
(45) Date of Patent: Apr. 12, 2011

(54) LATCH ASSEMBLY

(75) Inventor: Fangchang Fan, Tianjin (CN)

(73) Assignee: Eversafety Precision Industry (Tianjin) Co., Ltd., Tianjin (CN)

( * ) Notice: Subject to any disclaimer, the term of this patent is extended or adjusted under 35 U.S.C. 154(b) by 881 days.

(21) Appl. No.: 11/854,536

(22) Filed: Sep. 12, 2007

(65) Prior Publication Data

US 2009/0064737 A1 Mar. 12, 2009

(51) Int. Cl.
*E05B 65/10* (2006.01)

(52) U.S. Cl. ..... 292/1.5; 292/163; 292/169; 70/107

(58) Field of Classification Search ..... 292/337, 292/169, DIG. 61, 165, 1.5, 244, 163, 169.13–169.19, DIG. 60; 70/107

See application file for complete search history.

(56) References Cited

U.S. PATENT DOCUMENTS 4,602,490 A * 7/1986 Glass et al. ..... 70/134
4,768,817 A * 9/1988 Fann et al. ..... 292/1.5
5,551,264 A * 9/1996 Fann et al. ..... 70/134
6,318,769 B1 * 11/2001 Kang ..... 292/1.5
6,443,503 B1 * 9/2002 Lu et al. ..... 292/1.5
6,536,812 B1 * 3/2003 Winardi ..... 292/1.5
6,928,844 B2 * 8/2005 Chiang et al. ..... 70/109

* cited by examiner

*Primary Examiner* — Carlos Lugo
*Assistant Examiner* — Kristina R Fulton

(57) ABSTRACT

A latch assembly having adjusting backset includes a casing, a latch bolt and a latch rear section. The latch bolt includes a bolt body and a fixed member connected with the bolt body. The top of the fixed member includes two positioning notches adapted to different backsets. A positioning member and the fixed member are disposed in a slide. The positioning member includes a positioning projection corresponding to the positioning notch at the front portion thereof. The latch includes a pin that can lift the positioning member to disengage the positioning projection from the positioning notch. Then, the positioning projection is moved to another positioning notch, thereby changing the backset. The latch assembly includes a positioning spring to keep the positioning projection fixed in the positioning notch. The latch assembly may include an upper connecting member, a lower connecting member and an assembly member to strengthen the latch assembly.

12 Claims, 5 Drawing Sheets

LATCH ASSEMBLY

BACKGROUND OF THE INVENTION

1. Field of the Invention

The present invention relates generally to a latch assembly, and in particular to a latch assembly having an adjustable backset.

2. The Prior Arts

"Backset" refers to the distance from the edge of the door to the center of the hole drilled for the lock. Most locks have backsets of 60 millimeters or 70 millimeters.

The user has to drill the hole on the door to install the lock, and the location of the hole is determined by the backset dimension of the door lock. If the door lock is out of order and needs to be replaced, the user needs to purchase a door lock with the same backset as the one to be replaced. Accordingly, the lock manufacturers have to produce latches in two different backsets to satisfy the needs of the users and the users have to purchase the appropriate locks according to the holes drilled on the doors.

However, for the manufacturers, manufacturing latches in two different backsets is hard to improve the production efficiency. For the users, it is likely to purchase the lock having a different backset.

In order to solve the problems mentioned above, a latch assembly of a lock having an adjustable backset has been proposed. The latch assembly includes an inner lock body, an outer lock body and a latch. The latch includes a casing, and a latch bolt and a latch rear section disposed in the casing. The latch bolt includes a bolt body and a fixed member connected with one end of the bolt body. The latch rear section holds the fixed member between an upper connecting member and a lower connecting member, on which pin holes are formed. As a pin is positioned at the first backset position, the latch assembly is adapted to the 60-millimeter backset distance. As a pin is positioned at the second backset position, the latch assembly is adapted to the 70-millimeter backset distance.

The backset of the latch assembly mentioned above is adjusted by regulating the position of the pin so that the fixed member can slide in a space inside the latch rear section. But this kind of latch assembly has many disadvantages, which are described as follows.

The backset of the latch is solely determined by the position of the pin. If the position of the pin is changed unintentionally, the backset of the latch is also changed unintentionally. Moreover, after the backset of the latch is adjusted, it is possible that the latch bolt is protruded out of the faceplate and can not be withdrawn back to the casing. Thus, the latch can not work normally.

Furthermore, because the length of the latch is determined by the relative position of the fixed member to the upper and lower connecting members. When the fixed member is projected out of the space between the upper connecting member and the lower connecting member, the strength of the latch is reduced.

SUMMARY OF THE INVENTION

A primary objective of the present invention is to provide a latch which is easy to adjust the backset, can avoid unintentional backset changing, and has high strength.

The latch according to the present invention includes a casing, and a latch bolt and a latch rear section, which are both disposed in the casing. The latch bolt includes a bolt body and a fixed member connected with one end of the bolt body. Also, the fixed member is placed in a groove space of a slide. The top of the front portion of the fixed member is formed with two spaced positioning notches and the back portion of the fixed member is formed with an oval positioning groove.

A positioning member assembled with the fixed member is also disposed in the groove space of the slide. The top of the front portion of the positioning member is formed with a positioning projection, the shape of which is corresponding to that of the positioning notches of the fixed member. A pin hole is formed on the back portion of the positioning member.

A fixing pin passes through the pin hole of the positioning member and the positioning groove of the fixed member, and both ends of the fixing pin are respectively fixed at the two sides of the slide.

One end of a positioning spring is engaged with a positioning hook formed at the bottom of the slide and the other end of the positioning spring is contacted with a flat area formed on the positioning member.

A pin is inserted in a vertically oval pin holes formed at the back portion of the casing for supporting the bottom of the front portion of the positioning member.

The latch rear section includes an upper connecting member and a lower connecting member, which are engaged with each other.

The front portions of the upper connecting member and the lower connecting member are respectively formed with an oval positioning slot corresponding to the vertical pin hole of the rear portion of the casing. The pin passes through the positioning slots formed on the upper connecting member and the lower connecting member.

An assembly member is disposed in the assembly space between the upper connecting member and the lower connecting member. The front portion and the back portion of the assembly member are respectively formed with a fixing hole, which are corresponding to fixing holes formed on the upper connecting member and the lower connecting member. Also, the middle portion of the assembly member is formed with an arc-shape notch corresponding to pivot holes formed on the upper connecting member and the lower connecting member. An opening is formed on the top of the assembly member.

One end of a lever passes through the opening on the top of the assembly member and is inserted in an opening formed on the back of the slide and the other end of the lever is disposed in the arc-shape notch of the assembly member and is capable of rotating in the arc-shape notch.

Because the positioning projection of the positioning member is fixed in the positioning notch of the fixed member by means of the positioning spring, the length of the latch can be adjusted easily and will not be changed unintentionally. Moreover, when the backset of the latch according to the present invention is changed, the fixed member and the slide are always kept in the assembling space between the upper connecting member and the lower connecting member. Thus, the strength of the latch according to the present invention is stronger than that of the conventional latch.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
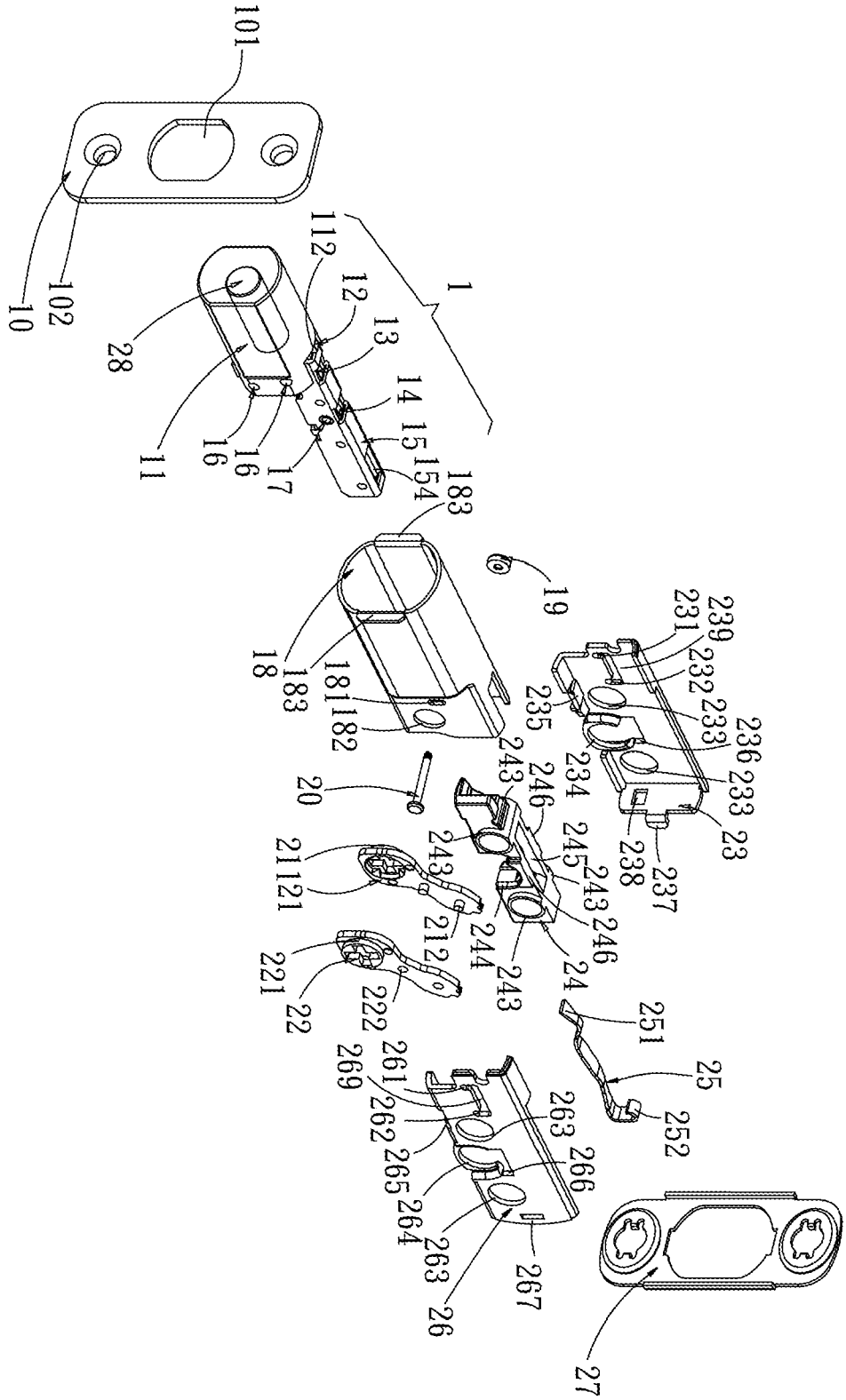
FIG. 1 is an exploded perspective view of the latch assembly according to an embodiment of the present invention.
Figure 2:
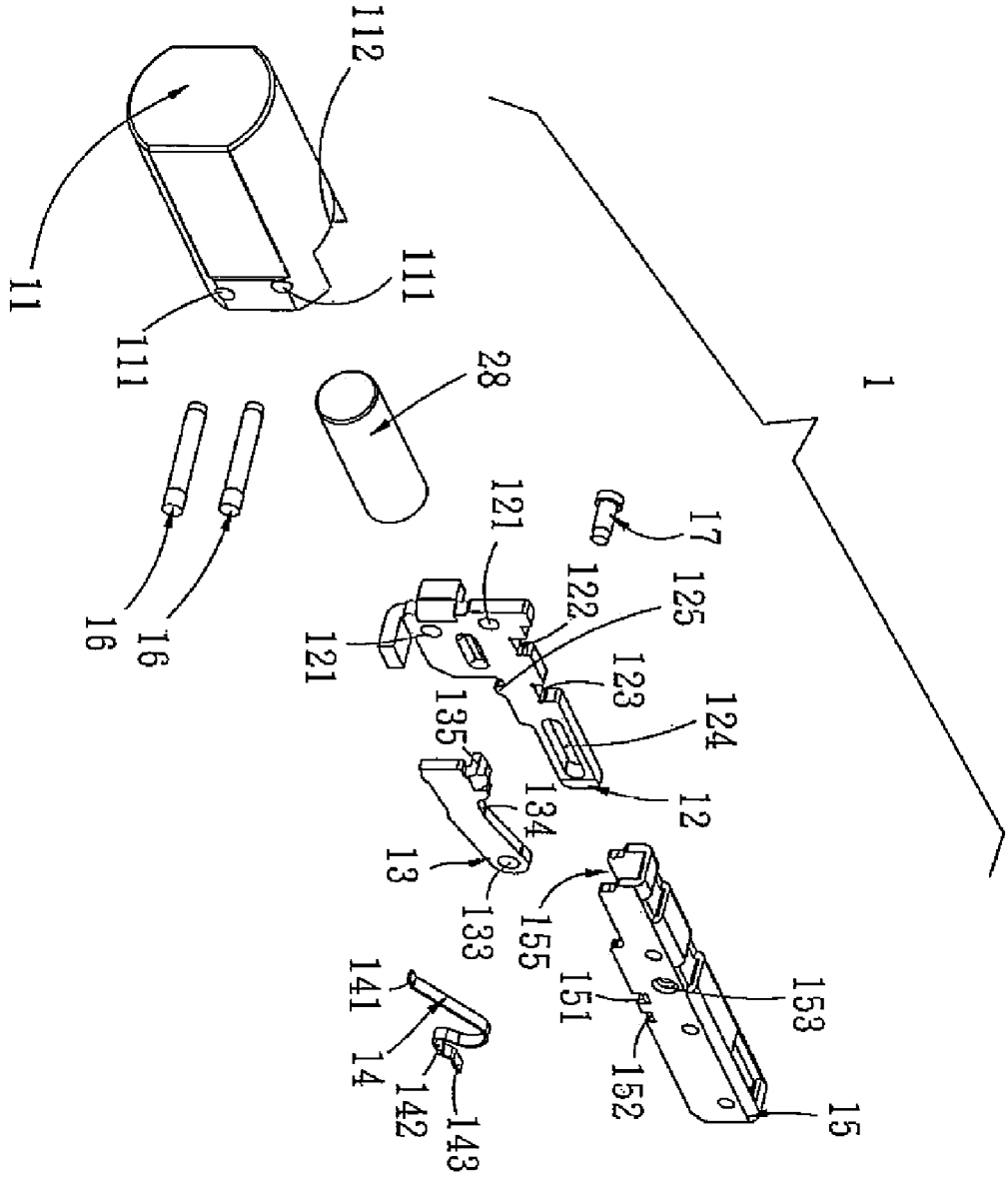
FIG. 2 is an exploded perspective view of a latch bolt according to the embodiment of the present invention.

With reference to FIGS. 1 and 2, a latch assembly according to the present invention includes a casing 18, and a latch bolt 1 and a latch rear section, both of which are disposed in the casing 18. Two ears 183 are formed on the two sides of the front end of the casing 18. A back faceplate 27 sleeves on the casing 18 and contacts with the two ears 183. Also, a front faceplate 10 corresponding to the back faceplate 27 is mounted on the front end of the casing 18. The front faceplate 10 having two fixing holes 102 is provided for installing the latch assembly into the door. Also, the front faceplate 10 is provided with a latch hole 101. The bolt 1 is capable of being protruded out of the latch hole 101, and the casing 18 contacts with the front faceplate 10 and communicates with the latch hole 101. The back section of the casing 18 is provided with a vertical oval pin hole 181 and a fixing hole 182.

The latch bolt 1 includes a bolt body 11 and a fixed member 12 connected with one end of the bolt body 11. A rigid rod 28 is disposed inside the bolt body 11 and a notch 112 is formed at the back end of the bolt body 11. Also, two pin holes 111 are formed on the side walls of the notch 112. Accordingly, two pin holes 121 corresponding to the pin holes 111 of the bolt body 11 are formed on the front portion of the fixed member 12. Fixing pins 16 pass through the pin holes 111 of the bolt body 11 and the pin holes 121 of the fixed member 12, thereby connecting the bolt body 11 with the fixed member 12.

Moreover, the top of the fixed member 12 is provided with two spaced positioning notches 122 and 123. The positioning notch 122 is for a 60-millimeter backset and the positioning notch 123 is for a 70-millimeter backset. Also, the back portion of the fixed member 12 is provided with an oval positioning groove 124. A protrusion 125 formed at the bottom of the fixed member 12 forms a groove at the bottom of the fixed member 12.

Also, the latch bolt 1 includes a slide 15 with a groove space 155, in which the fixed member 12 is disposed. A pin hole 153 is formed on each side wall of the slide 15. The bottom of the slide 15 is provided with two spaced positioning hooks 151 and 152.

Moreover, a positioning member 13 and the fixed member 12 are disposed side by side and in the groove space 155 of the slide 15. The positioning member 13 is provided with a positioning projection 135 on the top of the front portion thereof. The shape of the positioning projection 135 is corresponding to those of the positioning notches 122 and 123 of the fixed member 12 so that the positioning projection 135 can be engaged with the positioning notch 122 or 123. Furthermore, a flat area 134 is formed on the top of the positioning member 13 behind the positioning projection 135 and a pin hole 133 is formed at the back portion of the positioning member 13.

A fixing pin 17 passes through the pin holes 153 of the slide 15, the pin hole 133 of the positioning member 13 and the positioning groove 124 of the fixed member 12, thereby fixing the fixed member 12 and the positioning member 13 inside the groove space 155 of the slide 15. Furthermore, a side surface of the positioning member 13 is contacted with a side surface of the fixed member 12.

One end 141 of a positioning spring 14 presses on the flat area 134 of the positioning member 13 and the other end 143 is engaged with the positioning hooks 151,152 of the slide 15. Specifically, the end 143 of the positioning spring 14 is contacted with the top surface of the positioning hook 152 and a bending portion 142 close to the end 143 is contacted with the bottom surface of the positioning hook 151, thereby fixing the end 143 on the slide 15. The positioning spring 14 according to the present invention can provide a downward force to the front portion of the positioning member 13, thereby firmly keeping the positioning projection 135 in the positioning notch 122 or 123.

A pin 20 passes through the vertical pin hole 181 of the casing 18 and the groove formed at the bottom of the fixed member 12 by the protrusion 125, and supports the front end of the positioning member 13. Also, one end of the pin 20 projected out of the casing 18 works as a handle to adjust the backset. The other end of the pin 20 is engaged with a pin cover 19 to prevent the pin 20 from disengaging from the pin hole 181.

As the pin 20 is pushed upward along the pin hole 181, the pin 20 pushes up the positioning member 13. Thus, the positioning projection 135 of the positioning member 13 is disengaged from the positioning notch 122 of the fixed member 12. The slide 15 is then moved backward. The fixing pin 17 passing through the pin hole 153 of the slide 15 and the pin hole 133 of the positioning member 13 is also slid backward along the positioning groove 124 to the back end position of the positioning groove 124. Then, the positioning projection 135 falls down into the positioning notch 123. At last, the pin 20 is pushed downward along the pin hole 181. Therefore, the positioning projection 135 is firmly engaged with the positioning notch 123. The length of the latch bolt 1 is increased and the backset is changed from 60 millimeters to 70 millimeters. From above descriptions, the elastic force of the positioning spring 14 keeps the positioning projection 135 in the positioning notch 122 or 123, so the positioning projection 135 will not be accidentally disengaged from the positioning notch 122 or 123. Thus, the length of the latch bolt 1 can be adjusted easily and will not be changed unintentionally.

In order to strengthen the latch after its length being increased, the latch rear section according to the present invention is improved, which is described as follows.

The latch rear section according to the present invention includes an upper connecting member 26 and a lower connecting member 23, which are engaged with each other. The front portion and the back portion of the upper connecting member 26 are respectively formed with a fixing hole 263, and the upper connecting member 26 are formed with a pivot hole 264 between the two fixing holes 263. Also, the front portion and the back portion of the lower connecting member 23 are respectively formed with a fixing hole 233, and the lower connecting member 23 is formed with a pivot hole 234 between the two fixing holes 233. Moreover, the front portion of the upper connecting member 26 is provided with an oval positioning slot 269, the two ends of which are respectively formed with a vertical oval groove 261, 262. Also, the front portion of the lower connecting member 23 is provided with an oval positioning slot 239, the two ends of which are respectively formed with a vertical oval groove 231, 232. The positions of the positioning slot 239 and the positioning slot 269 are corresponding to the position of the pin hole 181 of the casing 18. The pin 20 passes through the pin hole 181 of the casing 18, the positioning slot 269 of the upper connecting member 26, the positioning slot 239 of the lower connecting member 23, and the pin hole 181 on the other side of the casing 18.

Further, in order to assemble the upper connecting member 26 with the lower connecting member 23, a hole is formed on the upper connecting member 26 and a corresponding protrusion is formed on the lower connecting member 23. Specifically, the back end of the upper connecting member 26 is provided with a hole 267, and the back end of the lower connecting member 23 is provided with a protrusion 237 that is perpendicular to the body of the lower connecting member 23 and corresponding to the hole 267. The protrusion 237 of the lower connecting member 23 is engaged with the hole 267 of the upper connecting member 26, thereby fixing the upper connecting member 26 and the lower connecting member 23 together.

Furthermore, an assembly member 24 is disposed in the space between the upper connecting member 26 and the lower connecting member 23. Both the front portion and the back portion of the assembly member 24 are respectively provided with a fixing hole 243, which is corresponding to the fixing hole 263 of the upper connecting member 26 and the fixing hole 233 on the lower connecting member 23. Also, the assembly member 24 is provided with an arc-shape notch 244 at the middle portion, which is corresponding to the pivot hole 264 of the upper connecting member 26 and the pivot hole 234 of the lower connecting member 23. An opening 245 is formed on the top of the assembly member 24.

Moreover, two ends of the fixing holes 243 of the assembly member 24 are respectively provided with protruding edges so that the fixing holes 243 can be easily engaged with the pivot holes 263 of the upper connecting member 26 and the pivot holes 233 of the lower connecting member 23. Because the protruding edges of the fixing holes 243 are engaged with the pivot holes 263 of the upper connecting member 26 and the pivot holes 234 of the lower connecting member, it is easy to align and assemble the assembly member 24 with the upper connecting member 26 and the lower connecting member 23.

The assembly member 24 may further include a protrusion 246 on the top of the arc-shape notch 244. Correspondingly, the pivot hole 264 of the upper connecting member 26 and the pivot hole 234 of the lower connecting member 23, which are corresponding to the arc-shape notch 244, are respectively provided with a notch 266, 236 at the top thereof. The protrusion 246 above the arc-shape notch 244 is engaged with the notches 266 and 236.

The latch according to the present invention includes a lever. One end of the lever passes through the opening 245 on the top of the assembly member 24 and enters an opening 154 formed on the top of the slide 15; the other end of the lever is engaged with the arc-shape notch 244 of the assembly member 24 and can rotate therein. Also, when one end of the lever engaged with the arc-shape notch 244 is rotating, the other end passing through the opening 245 can move horizontally and simultaneously drive the slide 15 to move horizontally. Therefore the latch bolt 1 can be driven to extend out or retract in the casing 18.

Moreover, both sides of the lever are respectively formed with a protrusion at the end that is disposed in the arc-shape notch 244 of the assembly member 24. The edges of the protrusions at the side surfaces of the lever are contacted with the inner walls of the pivot holes 234, 264 and the inner wall of the protrusion 246 of the assembly member 24. Thus the lever is disposed in the assembly member 24.

The lever may include a first lever 21 and a second lever 22. A side surface of the first lever 21 is formed with at least one projecting cylinder 212 and a side surface of the second lever 22 is formed with at least one hole 222 corresponding to the projecting cylinder 212. Thus, the projecting cylinder 212 can be fitted into the hole 222, thereby fixing the first lever 21 and the second lever 22 together.

The protrusion formed on one end of the lever may have a lower projecting edge, as shown in FIG. 1, the lower projecting edge 211 of the first lever 21 and the lower projecting edge 221 of the second lever 22. Also, the latch according to the present invention may include a driving spring 25, both ends of which are fixed in the latch rear section. Specifically, the middle portion of the driving spring 25 is tightly contacted with the lower projecting edge of the lever so that the elastic force applied to the lower projecting edge can drive the lever to rotate easily from the vertical position in the middle of the opening 245 of the assembly member 24 to the two ends of the opening 245. The back end 252 of the driving spring 25 is mounted in a rectangular hole 238 of the lower connecting member 23, and the front end 251 is fixed between connecting portions 265, 235 respectively disposed at the bottom of the upper connecting member 26 and the lower connecting member 23. As the latch bolt 1 extends out or retracts in the casing 18, one end of the lever passing through the opening 245 on the top of the assembly member 24 is positioned at the front or back end of the opening 245. For example, in the process of the latch bolt 1 extending out of the casing 18, one end of the lever is positioned at the back end of the opening 245, and then the lever is rotated so that one end of the lever can move horizontally along the opening 245. Because the middle portion of the driving spring 25 is tightly contacted with the lower projecting edge of the lever, in the process of one end of the lever moving from the back end of the opening 245 to the vertical position in the middle of the opening 245, the driven rotating force to the lever is gradually increased. After one end of the lever passes through the middle vertical position, the end can move from the middle vertical position to the front end of the opening 245 smoothly and easily due to the elastic force of the driving spring 25 to the lower projecting edge of the lever. Therefore, the latch bolt 1 can be driven to extend out of the casing 18.

Figure 3:
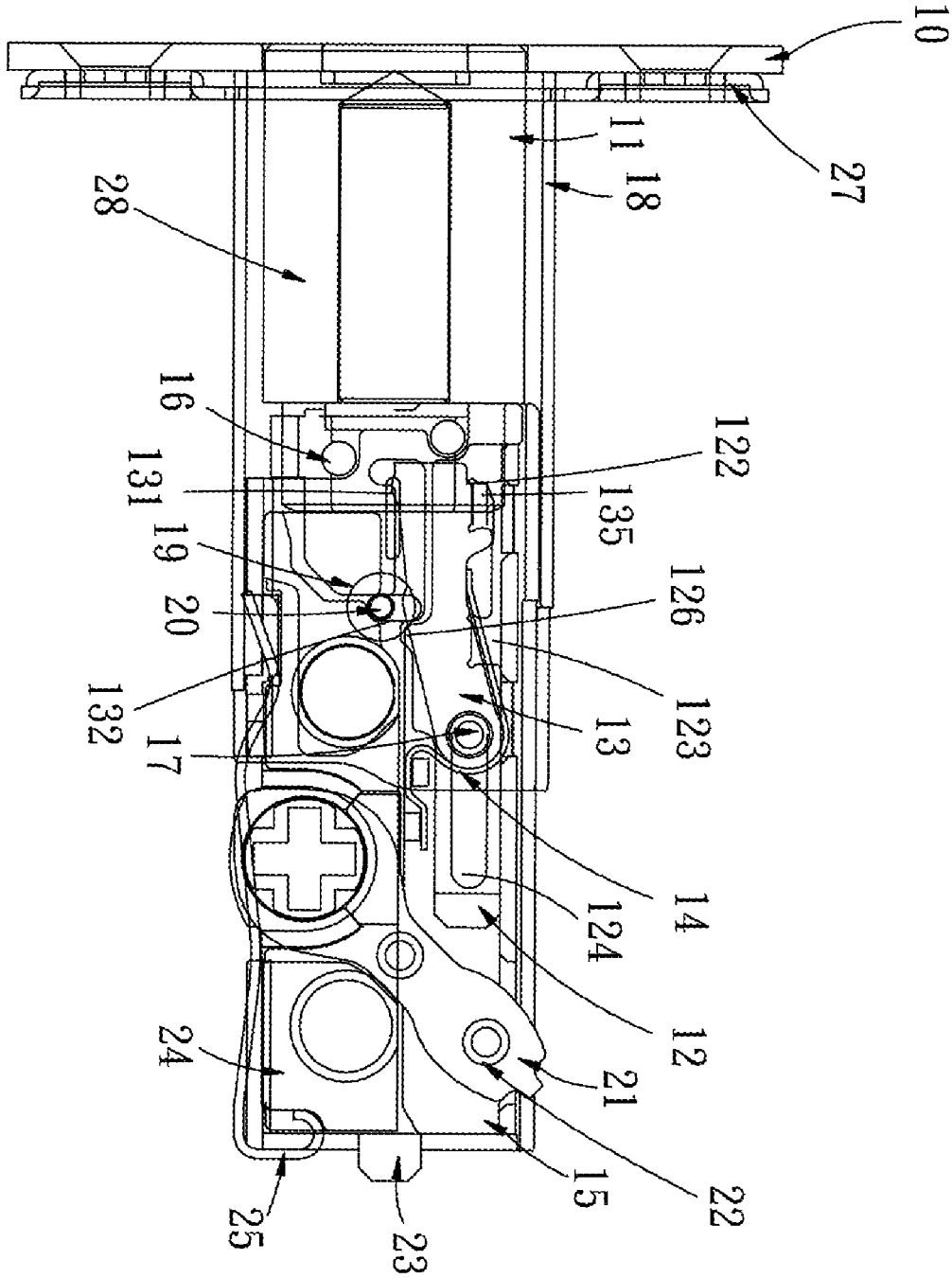
FIG. 3 is a schematic view showing the latch assembly according to the present invention in a 60-millimeter backset state.

FIG. 3 is a schematic view showing the latch according to the present invention in the 60-millimeter backset state, in which the fixing pin 17 is positioned at the front end of the positioning groove 124 and the positioning projection 135 is positioned in the positioning notch 122.

Figure 4:
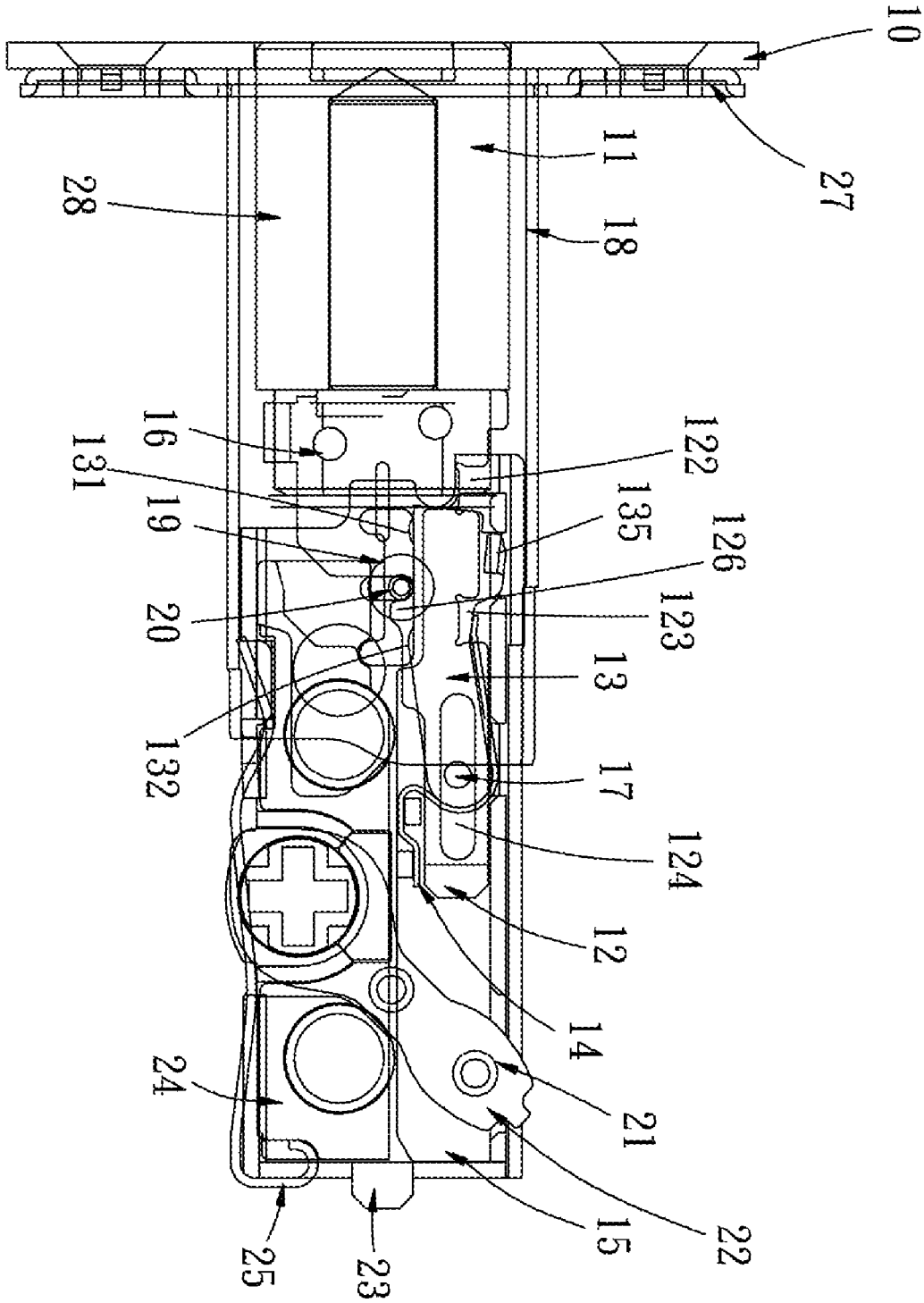
FIG. 4 is a schematic view showing an adjusting process of the latch assembly according to the present invention from the 60-millimeter backset state to a 70-millimeter backset state.

FIG. 4 is a schematic view showing the moving process of the latch from the 60-millimeter backset state to the 70-millimeter backset state. During this process the pin 20 is lifted up to push the positioning member 13 upward so that the positioning projection 135 is disengaged from the positioning notch 122 and is moved toward the positioning notch 123.

Figure 5:
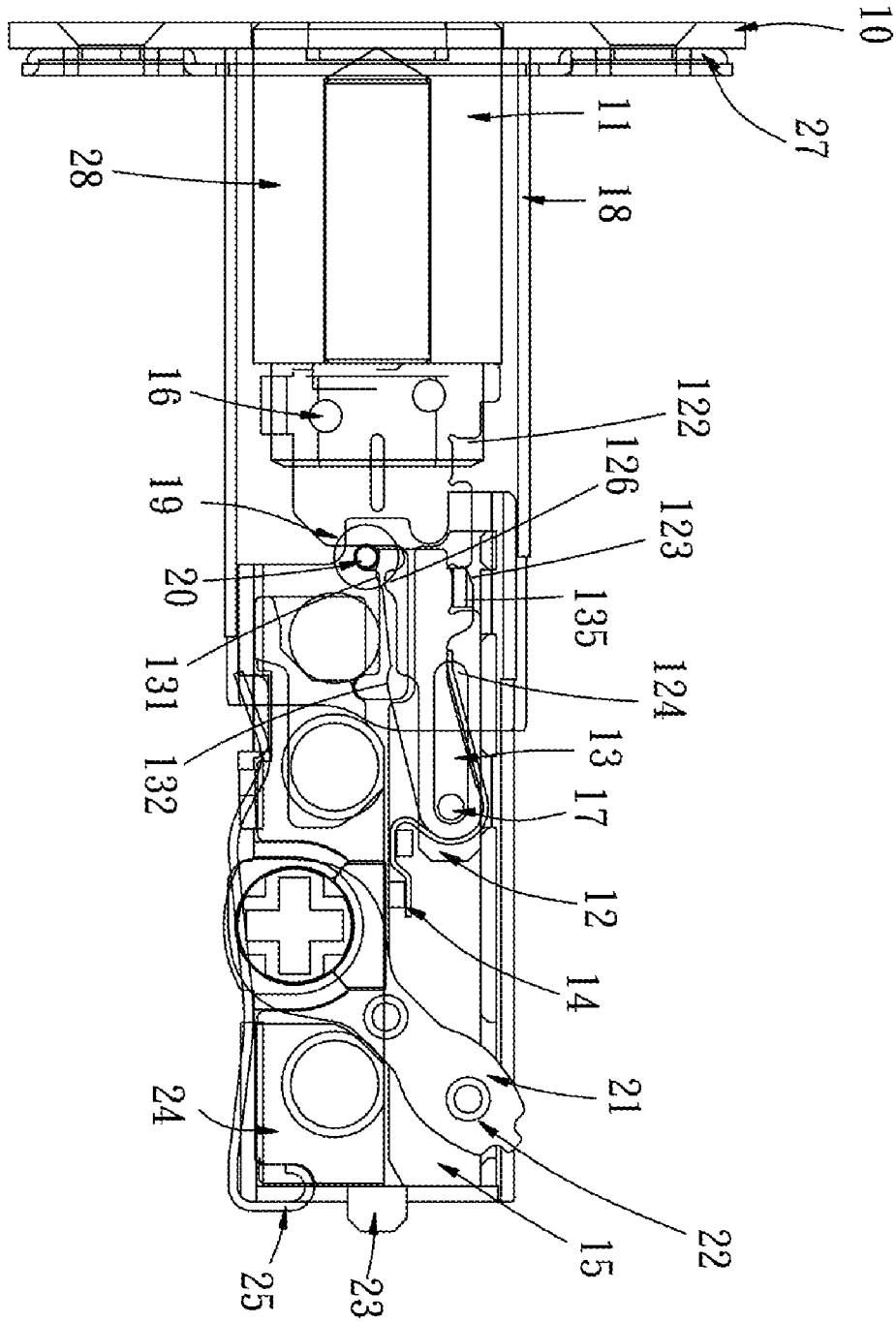
FIG. 5 is a schematic view showing the latch assembly according to the present in the 70-millimeter backset state.

FIG. 5 is a schematic view showing the latch according to the present invention in the 70-millimeter backset state. The fixing pin 17 is positioned at the back end of the positioning groove 124, and the positioning projection 135 is positioned in the positioning notch 123. The backset of the latch is extended from 60 millimeters to 70 millimeters.

When the backset of the latch according to the present invention is changed, the fixed member 12 and the slide 15 are always kept in the assembling space between the upper connecting member 26 and the lower connecting member 23. Moreover, the assembly member 24 is also disposed in the assembling space between the upper connecting member 26 and the lower connecting member 23, so the strength of the latch according to the present invention is higher than that of the conventional latch.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A latch assembly, comprising:

a casing;

a latch bolt disposed in the casing and comprising a bolt body and a fixed member connected with one end of the bolt body; and a latch rear section disposed in the casing;

wherein the fixed member is disposed in a groove space of a slide; a top at a front portion of the fixed member is formed with two spaced positioning notches and a back portion of the fixed member is formed with an oval positioning groove;

a positioning member disposed side by side with the fixed member is disposed in the groove space of the slide; a top at a front end of the positioning member is formed with a positioning projection having a shape corresponding to the shape of the positioning notches of the fixed member; a pin hole is formed at a back portion of the positioning member;

a fixing pin passes through the pin hole of the positioning member and the positioning groove of the fixed member, and both ends of the fixing pin are respectively fixed in two side surfaces of the slide;

one end of a positioning spring is fixed with positioning hooks formed on a bottom of the slide and the other end of the positioning spring presses on a flat area formed on the positioning member; and a pin passes through a vertical oval pin hole formed on a back portion of the casing for supporting a bottom of the front end of the positioning member.

2. The latch assembly as claimed in claim 1, wherein the latch rear section comprises an upper connecting member and a lower connecting member, which are engaged with each other;

front portions of the upper connecting member and the lower connecting member are respectively formed with an oval positioning slot corresponding to the vertical oval pin hole of the casing; the pin passes through the oval positioning slots formed on the upper connecting member and the lower connecting member;

an assembly member is disposed in an assembly space between the upper connecting member and the lower connecting member; both a front portion and a back portion of the assembly member are respectively formed with a fixing hole; the fixing holes of the assembly member are respectively corresponding to fixing holes formed on the upper connecting member and the lower connecting member; a middle portion of the assembly member is formed with an arc-shape notch corresponding to pivot holes formed on the upper connecting member and the lower connecting member; an opening is formed on a top of the assembly member; and one end of a lever passes through the opening on the top of the assembly member and then enters an opening formed on a top of the slide, and the other end of the lever is disposed in the arc-shape notch of the assembly member and is capable of rotating in the arc-shape notch.

3. The latch assembly as claimed in claim 2, wherein a back end of the lower connecting member is provided with a protrusion vertical to the lower connecting member and a back end of the upper connecting member is provided with a hole corresponding to the protrusion of the lower connecting member;

and the protrusion of the lower connecting member is fitted in the fixing hole of the upper connecting member, thereby connecting the upper connecting member with the lower connecting member.

4. The latch assembly as claimed in claim 2, wherein the two sides of the fixing holes of the assembly member are respectively provided with a protruding edge; and the protruding edges of the fixing holes of the assembly member are inserted in the fixing holes of the upper connecting member and the lower connecting member.

5. The latch assembly as claimed in claim 2, wherein the assembly member is provided with a protrusion on a top of the arc-shape notch;

the pivot holes of the upper connecting member and the lower connecting member are respectively provided with a notch at tops of the pivot holes thereof; and the protrusion on the top of the arc-shape notch is assembled with the notches at the tops of the pivot holes of the upper connecting member and the lower connecting member.

6. The latch assembly as claimed in claim 5, wherein two side surfaces of the lever are respectively formed with a protrusion at the end that is engaged with the arc-shaped notch of the assembly member, and edges of the protrusions at the two sides surfaces of the lever are contacted with the inner walls of the pivot holes and the inner wall of the protrusion of the assembly member.

7. The latch assembly as claimed in claim 2, wherein the lever comprises a first lever and a second lever; a side surface of the first lever is formed with at least one projecting cylinder and a side surface of the second lever is formed with at least one hole corresponding to the projecting cylinder; and the projecting cylinder of the first lever is fitted into the hole of the second lever.

8. The latch assembly as claimed in claim 2, wherein a protrusion formed on one end of the lever has a lower projecting edge; and two ends of a driving spring are fixed in the latch rear section and a middle of the driving spring is tightly contacted with the lower projecting edge of the lever.

9. The latch assembly as claimed in claim 7, wherein a protrusion formed on one end of the lever has a lower projecting edge; and two ends of a driving spring are fixed in the latch rear section and a middle of the driving spring is tightly contacted with the lower projecting edge of the lever.

10. The latch assembly as claimed in claim 8, wherein a back end of the driving spring is mounted in a square hole formed on the lower connecting member, and a front end of the driving spring is fixed between connecting portions respectively formed on bottoms of the upper connecting member and the lower connecting member.

11. The latch assembly as claimed in claim 9, wherein a back end of the driving spring is mounted in a square hole formed on the lower connecting member, and a front end of the driving spring is fixed between connecting portions respectively formed on bottoms of the upper connecting member and the lower connecting member.

12. The latch assembly as claimed in claim 1, wherein one end of the positioning spring is contacted with a top surface of a first positioning hook formed at the bottom of the slide and a bending portion of the positioning spring is contacted with a bottom surface of a second positioning hook formed at the bottom of the slide.

* * * * *